US008079343B2

(12) United States Patent
Seagrave

(10) Patent No.: US 8,079,343 B2
(45) Date of Patent: Dec. 20, 2011

(54) POSITIVE-DISPLACEMENT TURBINE ENGINE

(76) Inventor: John Howard Seagrave, Bozeman, MT (US)

( * ) Notice: Subject to any disclaimer, the term of this patent is extended or adjusted under 35 U.S.C. 154(b) by 585 days.

(21) Appl. No.: 11/901,374

(22) Filed: Sep. 17, 2007

(65) Prior Publication Data

US 2009/0074567 A1 Mar. 19, 2009

(51) Int. Cl.

| | |
|---|---|
| ***F02B 53/00*** | (2006.01) |
| ***F01C 1/00*** | (2006.01) |
| ***F01C 1/32*** | (2006.01) |
| ***F04C 18/00*** | (2006.01) |
| ***F04C 2/00*** | (2006.01) |

(52) U.S. Cl. ..... 123/204; 417/227; 417/225

(58) Field of Classification Search ..... 418/225, 418/227, 45, 61.1, 103; 123/204–205
See application file for complete search history.

(56) References Cited

U.S. PATENT DOCUMENTS

| | | | | | |
|---|---|---|---|---|---|
| 1,831,263 | A * | 11/1931 | Ross | 123/241 |
| 1,922,477 | A * | 8/1933 | Flind | 418/227 |
| 2,919,062 | A * | 12/1959 | Tryhorn | 418/227 |
| 3,322,103 | A * | 5/1967 | Dirnberger | 418/227 |
| 3,636,930 | A * | 1/1972 | Okada | 418/227 |
| 3,885,531 | A * | 5/1975 | Zollenkopf | 123/229 |
| 4,055,156 | A * | 10/1977 | Salguero | 123/229 |
| 4,536,142 | A * | 8/1985 | Sumrall | 418/227 |
| 5,375,987 | A * | 12/1994 | Brent | 418/227 |
| 5,379,736 | A * | 1/1995 | Anderson | 123/204 |
| 5,819,699 | A * | 10/1998 | Burns | 123/234 |
| 7,458,791 | B2 * | 12/2008 | Radziwill | 418/225 |
| 2009/0220367 | A1 * | 9/2009 | Orban | 418/45 |

FOREIGN PATENT DOCUMENTS

DE 3130670 A * 2/1983

* cited by examiner

*Primary Examiner* — Thai Ba Trieu
(74) *Attorney, Agent, or Firm* — Antoinette M. Tease

(57) ABSTRACT

A positive-displacement turbine engine comprising two rotors, exhaust opening for discharging exhaust gas, intake opening for receiving air and fuel or air-fuel mixture, turbine channels, turbine shaft, plurality of turbine blades, and spark plug. The rotors share a single shaft and are positioned in the opposite sides of the combustion head. Each of the turbine channels has a constant depth and varying width and comprises an intake zone, compression zone, combustion-expansion power-stroke zone, and exhaust zone. Each of the turbine channels widens in the intake zone, narrows in the compression zone, widens in the combustion-expansion power-stroke zone, and narrows in the exhaust zone. The turbine blades maintain a constant lateral orientation while the two rotors rotate. Each turbine blade has a blade-rod with two ends and a downward-offset crank on one end of the blade-rod that maintains the turbine blade in a constant horizontal orientation during rotation of the rotors.

4 Claims, 4 Drawing Sheets

POSITIVE-DISPLACEMENT TURBINE ENGINE

Figure 1:
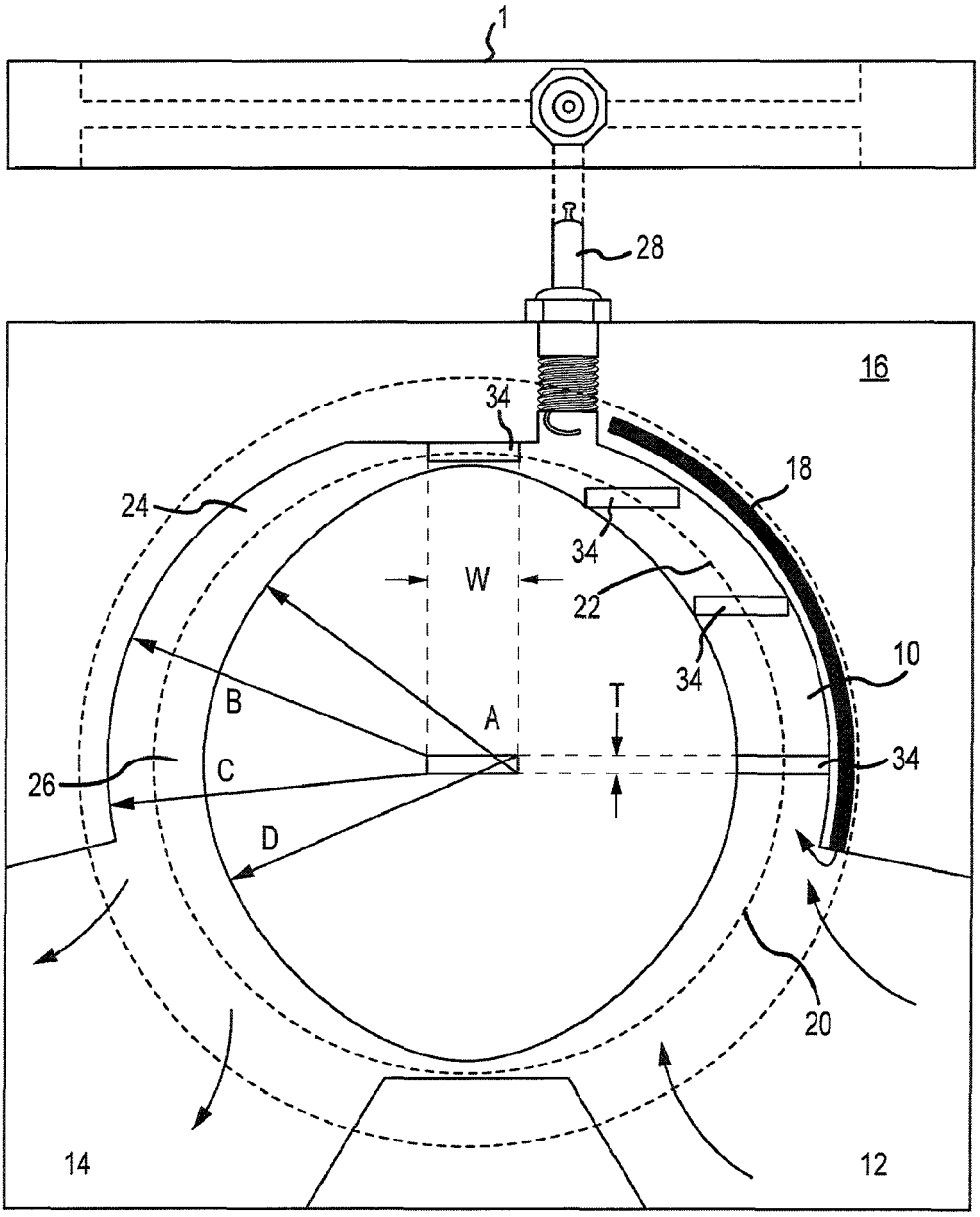

The object of the invention is to double fuel-efficiency in replacing piston engines and geared gas turbines.

BACKGROUND OF THE INVENTION

Gas turbines offer lower weight than a piston engine of equal power output, but at high rotational speed and cost—needing gear-reduction for direct application in place of a piston engine. Despite low mechanical friction, existing turbines have internal aerodynamic drag of the multiple stages of rotor blades revolving at high velocity. Mechanical balance is critical.

Geared gas turbines power helicopters, turboprop business planes and turboprop short-field transports; turbojets power fighters, and turbofans power airliners. Piercing whine, an original drawback of airborne turbines, has over the years been transformed into a satisfactory swish.

The piston engine offers moderate cost and high utility, but its mechanical friction seriously limits efficiency. A study by engine-pioneer Earle Ryder of heat rejection in a cylinder of a Pratt & Whitney 28-cylinder, 3,500 hp radial aircraft-engine reported, "The amount of heat that must be transferred to the cooling air is equal to about two-thirds of the energy delivered to the propeller during lean, low-power cruse."*

Accordingly,

Energy output to the propeller=$E_p$

Heat wasted=$\frac{2}{3}E_p$

Therefore, $E_p+\frac{2}{3}E_p=E_{fuel}$ $\frac{5}{3}E_p=E_{fuel}$ $\therefore E_p=\frac{3}{5}E_{fuel}$

* "Technicalities" by Peter Garrison, FLYING Magazine, November 1993 issue, Page 99.

That highly developed heavy-aircraft piston engine's energy-efficiency was only 60%: it wasted 40 percent of its fuel.

The low efficiency of piston engines originates in viscous friction of the lubricated pistons and piston rings sliding inside the cylinders.

Cooling methods to dispose of the frictional heat further subtract from the fuel energy: the stout metal structure that supports the fuel-heated combustion chambers conducts heat toward necessarily cooled moving parts lubricated by motor oil which decomposes at elevated temperatures.

In piston engines of many cylinders, the power-stroke of one cylinder helpfully overlaps the compression-stroke of another cylinder. In light-aircraft piston engines of few cylinders, propeller-inertia sustains rotation at idling speed. Automotive piston engines need a compact therefore massive flywheel.

Aviation piston engines serve at a wide range of torque but a moderate range of shaft rotational speed; consequently their dual ignition systems and other accessories are simple and reliable.

Automotive gasoline-fueled piston engines' ignition timing and fuel-air mixture are less simple on account of the widely variable loads and driving speeds. These design factors have been refined satisfactorily; mechanical and electrical failures infrequently occur among the somewhat complicated accessories. Wholly efficient combustion of fuel would exhaust pure carbon dioxide, yet contemporary gasoline-fueled piston engines exhaust some poisonous carbon monoxide and a significant unburned portion of the fuel. This necessitates pollution-reduction accessories.

Diesel piston engines are comparatively long-lived and efficient in service, burning the injected fuel centrally in the combustion chambers' hotly compressed air and thus quite thoroughly, causing minimal pollution and avoiding fuel-dilution of the lubricant on cylinder-walls. The necessary high compression ratio requires robust weighty mechanical parts. Diesels need accurately timed high-pressure fuel injection, also glow-plugs to enable cold startups; to cool the fuel injectors, fuel has to circulate continuously through them.

Plainly, piston engines arrived at usefulness through unbounded human tenacity.

Long confronted was the puzzle of how to invent a turbine engine having the positive compression-displacement of piston engines while avoiding their immoderate mechanical friction-losses.

Without intake and exhaust valves, without internal aerodynamic drag of multitudes of turbine blades fanning the air, without gear-reduction it would serve at the same convenient range of rotational speeds as piston engines.

BRIEF SUMMARY OF THE INVENTION

The described turbine with negligible mechanical and aerodynamic friction continuously delivers its full positive displacement during each shaft revolution, including intake, compression, ignition, expansion and exhaust. (Piston engines for automobiles and aircraft need two shaft revolutions.) Owing to the invention's steadiness of torque, there is no intrinsic necessity of a flywheel.

Absence of mechanical friction eliminates the need of a cooling system. The invention's operating temperature will reach a moderate mean value resulting from continual cool air-and-fuel-mixture intake, then heat of compression, then heat of combustion, then adiabatic temperature-reduction during power-stroke expansion—as would piston engines, but for their severe frictional heat. In case the lubricant in commercial roller bearings cannot withstand this operating temperature, silicone grease might serve.

The preferred configuration is of two rotors on a common shaft, both facing a central combustion-head having turbine-channels on both its sides. This offers lowest differential thermal expansion. For a desired displacement, it needs turbine blades of half the length required in a single-rotor configuration. Reduction of the blade-length dramatically reduces cyclic stress on the blades, a critical factor addressed below with research and a complete analysis.

Also considered was a single double-ended rotor with combustion heads at both ends; it would lack the cited advantages and need duplicate intake and exhaust ducting.

THE SEVERAL VIEWS OF THE DRAWINGS

The drawings follow the Abstract of the disclosure.

FIG. 1: the positive-displacement turbine channel and some explanatory turbine blades positioned in it.

Figure 2:
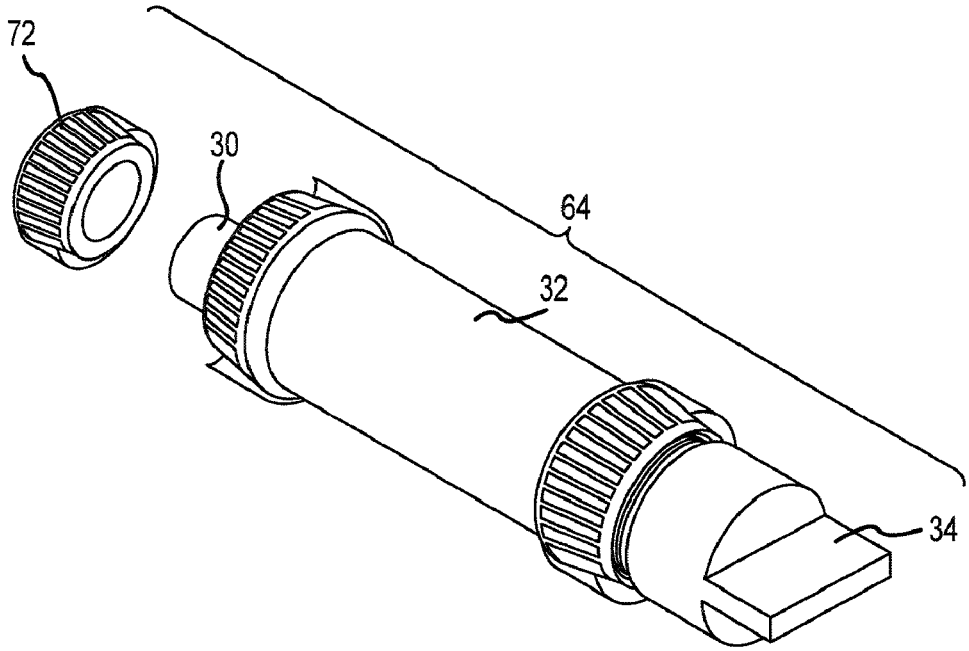

FIG. 2: a turbine Blade-Rod with its tapered-roller bearings.

Figure 3:
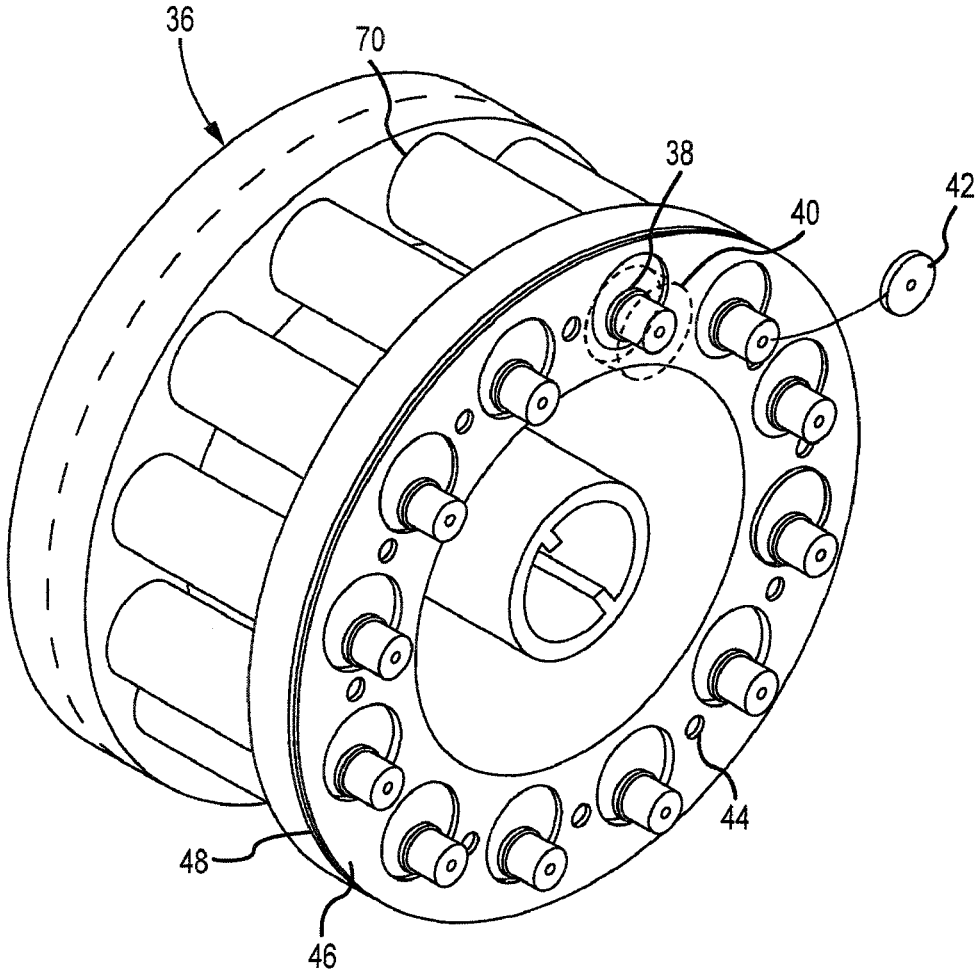

FIG. 3: a partially assembled Rotor with Blade-Rods installed, seen from the rear.

Figure 4:
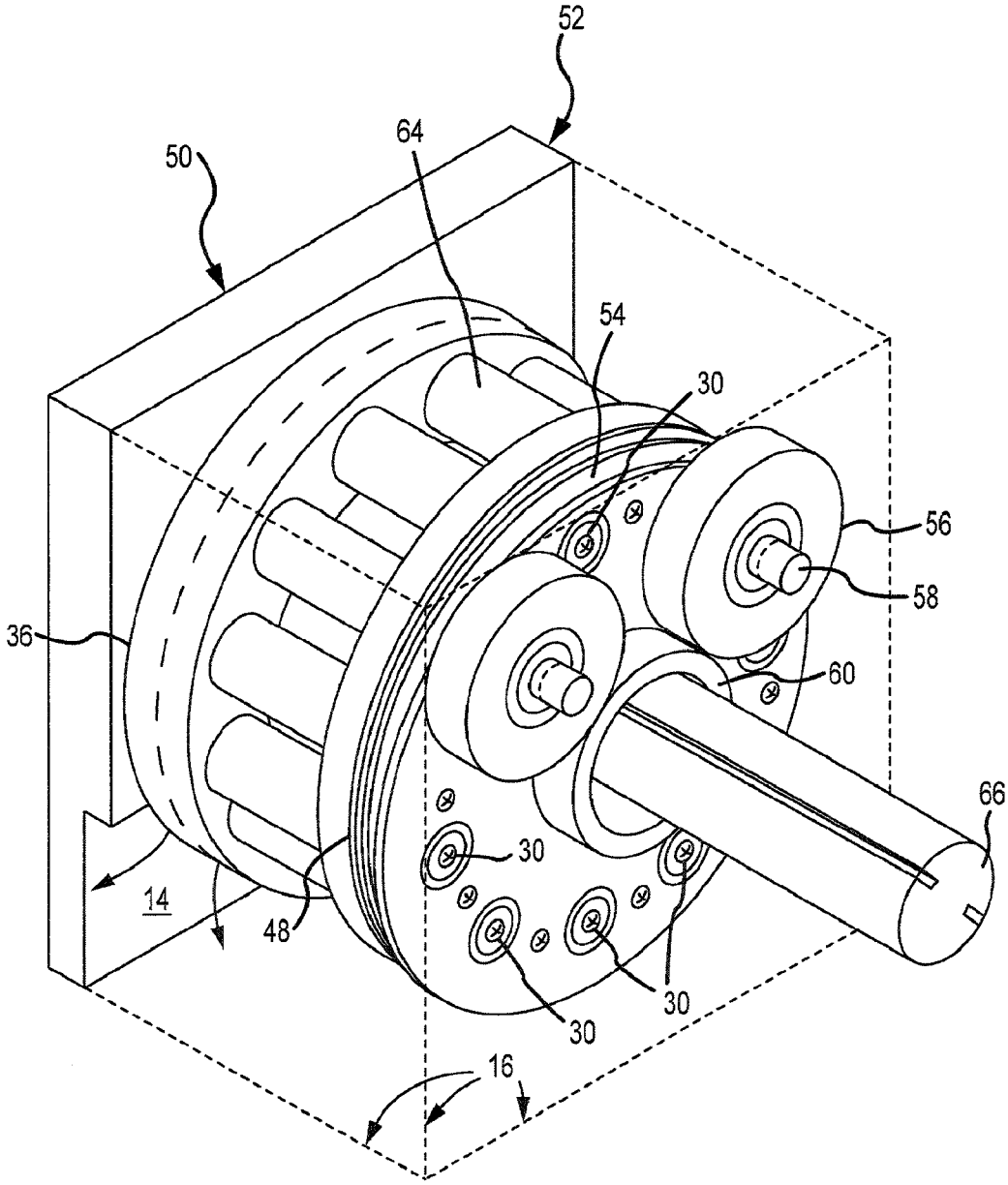

FIG. 4: the complete Rotor, facing the Combustion Head.

DETAILED DESCRIPTION OF THE INVENTION

The turbine as described is configured to operate with an automotive carburetor; fuel-injected and diesel-fueled developments of the invention are encouraged and are left to others.

Re FIG. 1 the turbine channel (10) in the Combustion Head is geometrically defined by lateral orientation of the Rotor's rectangular thin turbine blades (34) throughout engine rotation. Twelve of the turbine Blade-Rods (64) shown in FIG. 2 are supported parallel to the turbine shaft (66), very near the rotor's periphery (68).

The mechanical principle for this constant lateral orientation of the blades is presented below where FIG. 2, FIG. 3 and FIG. 4 are addressed.

Accordingly the turbine channel (10) widens to blade-width at both sides of the axis, and it narrows to blade-thickness (T) at the top and bottom of the circle.

Turbine rotation in FIG. 1 is counterclockwise. The four blades (34) that are outlined are in the turbine channel's compression zone (22); they are representative of the twelve blades total around the channel; passing the sparkplug(28), blades proceed through the widening power-stroke zone (24) to the exhaust zone (26), then deliver the exhaust through an outward opening (14) of the turbine channel.

Along the portion of turbine channel (10) between the exhaust-opening (14) and the intake-opening (12), edge-on blades conduct a minimal amount of exhaust at atmospheric pressure to the intake-zone (20). There, desired fuel-air mixture is sucked from the carburetor (not shown) to follow the blades as they enter the much-widened channel (10), near 3 o'clock in FIG. 1

As specified in FIG. 1 blade width (W) is 1.280 inches and blade thickness (T) is 0.298 inches. FIG. 1 also shows the scavenging channel (18) and the turbine cabinet (16), as well as the opposite facing turbine channel (10).

The turbine channel (10) is of a constant depth inward equal to blade-length (machine tolerances considered). Blade-length (L) for the experimental turbine's intended displacement is 0.625 inches, as derived at Pages 15 through 19 of this specification.

The turbine channel (10) is specified for machining by the radii as drawn in FIG. 1: the radii extend from the four corners of an in-scale turbine blade that is pictured at the center of the drawing. Entering successive quadrants of rotation a blade's particular edges that define the channel's inner and outer extent swap; the radii shown indicate this principle.

The channel (10) can be machined by an end-mill having a rotatory x-y table, using a cylindrical cutter of diameter equal to or less than the narrowest width of the channel, observing the drawing's radii and center-points while subtracting the tool-radius from the drawing radii to cut the outer channel-wall into the Combustion Head, and correspondingly adding the tool-radius to cut the inner channel-wall.

Toward uniform mechanical thermal expansion during operation, the second Rotor's turbine channel in the opposite face of the Combustion Head—not shown—is the same, except inverted, with that sparkplug downward, so as to distribute the heat of the two channels as evenly as possible across the Combustion Head. (Convenience of installation in a car might favor mounting the assembled turbine oriented with its sparkplugs in opposition horizontally.)

In FIG. 2, the Turbine Blade-Rod's (62) downward-offset crank (30) at its rear end —in readiness to receive its crank-bearing (72)—is the means by which each blade will be maintained in a constant lateral orientation during turbine rotation. This Figure shows the bearing inner-race spacer (32).

FIG. 3 shows a partially assembled Rotor with the Blade-Rods already installed (with their blades set to horizontal orientation). This Figure shows the front rotor face (36), the blade-rod crank's inner race positioning shoulder (38), the crank bearing location (40), the threaded holes (44) that holds screws (not shown) that secure the crank guide positioning disc (46) to the bearing retainer disc (48), and the washer-like disc that secures each crank bearing (42). It also shows the crank-guide positioning disc (46) not yet in a downward position and the bearing retainer disc (48) in position.

FIG. 4 shows the Crank-Positioning Disk-Assembly (54) engaging all of the Blade-Rods' (64) crank-bearings (not shown), keeping them positioned downward while it rotates in synchronism with the Rotor except around a downward-offset axis. This figure also shows the opposite rotor (50), the combustion head (52), the idler disc (56), the mounting stub (58), and the hub (60). Also shown are the shaft (66), the turbine cabinet (16), the bearing retainer disc (48), and the front rotor face (36).

Per FIG. 3, to reduce dead weight and inertia the Rotor's interior is first machined-away from the rear to leave a Rotor Center sized to engage the keyed Turbine Shaft—in this instance, of 2.36-inch diameter, equal to that of an automotive piston engine to be replaced experimentally. (Although the turbine as-sized will deliver somewhat more output torque than the replaced piston engine, the turbine's torque is not severely pulsating.)

This preliminary interior machining leaves a Front Rotor-Face of 0.75-inch thickness. The Rotor's periphery is next lathe-turned inward to leave a Front Flange with continuing smooth Front Rotor-face, its outer portion of 1.5-inch thickness toward the rear—and a Rear Flange of ¾-inch thickness, that is supported by a remaining half-inch-thick hollow cylinder of steel between flanges. The two flanges are of eleven-inch outside-diameter.

Finally the Blade-Rod support holes are bored from the rear—the shaped end of the tool leaving at the Front Rotor Face a shoulder to retain the outer race of the tapered-roller bearing at the blade-end of each Blade-Rod, when the Blade-Rods are inserted.

To assemble a rotor: the FIG. 2 Blade-Rods are inserted blade-first into the rear end of the Rotor until the Rods' front roller bearings seat within the Front Flange as described, with only the turbine blades protruding from the front face of the Rotor and the rear bearings of the Blade-Rods flush with the Rotor rear face—the Blade-rods' rear projecting cranks to be positioned downward.

Each Blade-Rod when seated extends ¾ of an inch beyond the front bearing-seat through close-fit clearance holes (70) in the Front Rotor-face, with only the turbine blades extending further. This close-fit distance between the Blade-Rod and the inside of the close-fit clearance hole (70) minimizes the escape of compressed gasses from the compression and expansion zones of the combustion channel; what little gas does escape will be cooled to rotor-temperature during its passage rearward through the close blade-rod clearance—avoiding excessive temperature reaching the bearing-lubricant. The principle of purging perilous combustible gas-mixture within the Turbine Cabinet is explained below.

Shown in FIG. 3, the ⅛-inch-thick steel Bearing-Retainer Disk has the same Blade-Rod hole-circle-centers as the Rotor itself; but the Bearing-Retainer Disk holes are of smaller size than the Rotor's, to restrain the Blade-Rods' rear support bearings' outer races fixedly against the high pressure of combustion upon the Blade-Rods. The Bearing Retainer Disk attaches with multiple flat-head machine-screws through countersunk holes that closely surround each blade-rod position, into tapped holes in the back face of the Rotor.

Those screws are not visible in FIG. 3 because they are covered by the Inner Crank-Guide-Positioning Disk shown in explanatory detail. This disk has bearing-support holes sized and lipped to engage the Blade-Rod Downward Cranks' small bearings' outer races—the bearings to be added next onto every Downward Crank.

These crank-size tapered-roller bearings are placed with their inner races against the shown positioning-shoulders of the Blade-Rod cranks, each bearing secured by an inner-race-size washer-like disk with spring-washer, screwed into a tapped center-hole in each Blade-Rod crank-end; the bearing-tapers need to face alternately inward and outward. This positions the outer races of the crank-bearings against the retaining lips of the manually downward-moved Inner Crank-Positioning-disk's lipped holes.

A ⅛-inch-thick Outer Crank-Positioning-Disk having a rear Hub (as shown in FIG. 4) and sharing around its periphery the same arrangement of lipped holes—these facing inward—is next installed using flat-head machine screws into the FIG. 3-*shown* threaded holes of the Inner Crank-Positioning Disk.

In this way the outer races of the securely attached Crank-Guide Bearings are captive between the pair of Crank-Positioning disks.

FIG. 4 shows how constant horizontal orientation of the turbine Rotor Blades is accomplished by the Crank-Positioning Disk-Assembly with its Hub kept positioned directly downward during turbine rotation by a pair of separate, bearing-supported thick Idler Disks matching the Hub dimensions. The Idler Discs' bearing-supports are horizontal stubs projecting from the close-by end-face of the turbine cabinet.

Accordingly the Rotor and Crank-Positioning Disk-Assembly rotate in unison about separated axes, and the downward-maintained Blade-Rod crank-bearings keep the turbine blades always laterally oriented.

Moreover, as installed, the alternating taper-directions of the cranks' bearing-rollers impart rigidity to the Crank-Positioning Disk-Assembly with its Hub.

Engine displacement is defined by GOOGLE Wickipedia as the total volume of air/fuel mixture an engine can draw in during one complete engine cycle.

The turbine's complete cycle is one shaft revolution. The volume of air-fuel mixture drawn in is the blade area times the inter-blade space times the number of inter-blade spaces for one revolution. This amounts to the blade area times the mean circumference of the turbine channel, minus the number of blades times the individual blade volume:

$$\begin{aligned}\text{Displacement} &= W \times L \times 2\Pi R - 11(W \times L \times T)\\ &= (1.28'')(0.625'')(2\Pi)(4.093'') - (1.28'')(0.6.25'')(0.298'')\\ &= 20.563 \text{ cu in} - 0.238 \text{ cu in}\\ &= 20.325 \text{ cubic inches.}\end{aligned}$$

Converting, (20.325 cu in)(16.387 cc/cubic inch)=333.1 cc=0.333 liters per rotor, or 0.666 liters total displacement.

The invention as described is sized to replace for test purposes a 1986 new-purchased durable Plymouth Minivan's four-cylinder four-cycle piston engine of 2.2 liter displacement that has a demonstrable 50% frictional power-loss at full power, typical of piston engines. A four-cycle engine is defined as requiring four strokes of the piston for each cycle: that is, two shaft revolutions.

A frictionless 0.55-liter turbine displacement per revolution, amounting to 1.1-liter per two revolutions, would suffice.

The described turbine's 0.666-liter displacement per revolution, 1.332 liter per two revolutions, should provide a welcome 0.232-liter increase in the test-car's liveliness.

Turbine Compression Ratio

Compression ratio as defined by the *New Illustrated Columbia Encyclopedia,* 1979, is "the ratio of the volume of the cylinder when the piston is at the bottom, to the volume when the piston is at the top".

Re FIG. 1, accordingly the turbine's compression ratio is the ratio of the volume between adjacent blades entering the compression-zone, to the volume of the space between blade-edges passing top dead center.

This ratio reduces to the blade width W times the inter-blade space S at the horizontal axis, divided by the blade thickness T times the blade edge-to-edge separation e at top dead center, or, R=WS/eT. (Blade-length L is an independent variable controlling the invention's displacement.)

That relates simply to the number of blades, N.

With the channel's mean radius r=4.093", blade width w=1.28", and blade thickness t=0.298", the inter-blade space S at the horizontal axis is $$\begin{aligned}\underline{S} &= (\text{circumference}/N) - t\\ &= 2\Pi(4.093/N) - 0.298\\ &= \underline{[(25.7/N) - 0.298]\text{ inches}}.\end{aligned}$$

The blade edge-to-edge separation at top dead center, e, =(circumference/N)−W=(25.7"/N)−1.28"

The 2.2 liter piston engine to be replaced has a 9.5:1 compression ratio.

The invention's closest-matching compression ratio is found by trial and error.

With $\underline{N = 11}$ blades, $$\underline{e} = 25.7''/11 - 1.28'' = \underline{1.056''} \therefore R = wS/eT = \frac{(1.28)(2{,}272)}{(0.862)(0.298)} = \underline{9.24:1}$$ compression ratio. (For $\underline{10}$ blades, the compression ratio $R$ is $\underline{7.57}$; and for $\underline{12}$ blades, $R$ is $\underline{11.32}$.)

Blade-Stress and Metal Fatigue

So as to analyze turbine blade stress and metal-fatigue, the gas-pressure against the Rotor-blades in the combustion-zone is derived with the help of *College Physics* by Franklin Miller Jr., 1987, Harcourt Brace Jovanovich, as follows.

Adiabatic process for an ideal gas is $$P_1V_1^{\gamma}=P_2V_2^{\gamma}$$

where γ is the ratio of specific heat capacities at constant pressure vs. constant volume.

For a diatomic gas such as oxygen, also nitrogen (these two constitute 99 percent of the atmosphere), the known value is $$\gamma=7/5=1.4.$$

Therefore, at an outside-limit turbine compression ratio of 10:1 volumetrically, the pressure ratio is found as $P_1/P_2=V_2^{\gamma}/V_1^{\gamma}=(V_2/V_1)^{\gamma}=(10:1)^{1.4}=10^{1.4}=25.1:1$.

Normal maximum atmospheric pressure is 14.7 psi at sea level.

Ignited constant-volume fuel-burn raises the pressure by a factor of about 1.3.

So 14.7 psi×25:1×1.3=478 psi.

The force on the blades' 0.381 $in^2$ area is 478 psi×0.381 $in^2$=182 lbs.

This peak force acts against adjacent blades, but each blade receives a lesser yet significant force on its opposite face; so the actual force is on the safe side of the calculated force.

Concerning blade fatigue: from *Mechanics of Materials*, second edition, by R. W. Fitzgerald, Addison-Wesley Publishing Company, 1982, Page 519, his Case 9 solution gives the mechanical load moment for a cantilever beam, under uniformly distributed load, as $M_{max}=wL^2/T$, where w is the distributed load—here equal to gas pressure—and L is the length of the turbine blade, and T is its thickness.

Solving this using 35,000 psi for the yield-point given for aluminum in tension (lower than for the same metal in compression), the necessary turbine-blade thickness, T, for an originally considered blade length of 1.56 inches or 3.96 cm, was T=0.0802 inches or 0.204 cm. This holds for any width of blade.

However, fatigue stresses at this loading would rapidly cause failure of the blades at their roots.

FIG. 10.26 in his *Mechanics of Materials* shows that reducing the stress to 20% of the yield stress will extend service-life beyond $500\times10^6$ cycles of loading—in this case shaft-revolutions.

However, per mile-of-distance covered by the intended test vehicle, its engine turns 2,281 revolutions. (And so at the car's top speed, 85 mph, its engine turns at 3,231 rpm.)

Between precautionary turbine-engine overhauls, the blade-fatigue-limited $500\times10^6$ engine-rotations at cruise would cover a distance of only 219,164 driven miles: insufficient.

Since the stress at the blade's root involves force times distance, reducing the blade-length under a given compression has a square-law effect in reducing the stress. To attain the minimum necessary 20% stress-reduction, blade-length could be reduced by 10 percent, to (0.9)(1.56 inches)=1.404 inches.

Fortunately, a frictionless-turbine displacement-per-revolution target of 0.75 liters would require a blade length of only 3.175 cm or 1.25 inches, extending service-life very acceptably.

The subsequent change to 0.666-liter displacement with the double-rotor embodiment now requires only half that 1.25-inch blade-length, 0.625 inches.

This and the substitution of steel for aluminum eliminate metal fatigue as a concern.

For safety, the turbine should withstand the stresses of a maximum rotational speed of 10,000 rpm. Centrifugal force on the turbine Rotor-blades is $F_c=Mv^2/r$, where M is the blade-mass, equal to the density of steel 7.8 g/$cm^3$ times the blade volume:

$$\text{Blade volume} = (1.59\text{ cm})(3.25\text{ cm})(0.757\text{ cm}) = \underline{3.91\text{ cm}^3}$$

$$\text{So } M = (3.91\text{ cm}^3)(7.8\text{ g/cm}^3) = 30.5\text{ g} = \underline{30.5\times10^{-3}\text{ kg}}$$

-continued $$\text{Effective radius } \underline{r} = 4.093\text{ inches} = 10.4\text{ cm} = \underline{.0104\text{ m}}$$

$$\underline{v} = 2\Pi r(10{,}000\text{ rpm})/(60\text{ sec/min}) = 2\Pi(.0104)(10{,}000/60) = \underline{10.89\text{ m/sec}}$$

$$Mv^2/r = (30.5\times10^{-3}\text{ kg})(10.89\text{ m/sec})^2/(.0104\text{ m}) \quad 31.93\text{ kg}\cdot\text{m}^2/\text{s}^2 = F_c$$

$$F_c = \underline{31.93\text{ newtons}};$$

(31.93 N)/(4.448 N/lb)=7.18 lb of centrifugal force. Compared to the gas pressures on the blades, this is negligible.

To calculate the centrifugal stress-limits on the steel of the Rotor itself, even at the moderate 3,231 maximum rpm in the test vehicle, is beyond my faculties.

So that will require alert road-testing.

Whine Suppression

To prevent piercing whine in the Positive Displacement Turbine, the angular separation of the turbine blades around the Rotor should be varied in sufficient increments while preserving symmetry and mechanical balance (others having apparently reduced this principle to practice). Although sound-power isn't decreased, avoidance of concentrated sound-power at a single frequency surely prevents auditory overload.

With an odd number of turbine blade-rods, it isn't simple to vary their angular separation while keeping mechanical balance.

To review the foregoing analysis of blade-stress, with the blade-length halved by the change in embodiment to a pair of facing rotors, it becomes both safe and beneficial to change the number of blades from 11 to 12, thereby increasing the turbine compression ratio from 9.24 to 11.32, without any risk of fatigue failure of the blades.

The even number of blade-rods readily permits turbine whine-suppression now by means of rotationally-balanced symmetrical variation in blade-rod angular spacing.

The accompanying increase in turbine compression ratio above that of the regular-unleaded-gasoline-burning test vehicle's piston engine may result in self-detonation of the fuel-air mixture; it may require a change to plus or premium gasoline.

As to the needed amount of variation in blade spacing for whine-suppression: a 1:2 change in spacing of a rotor's blades would cause an octave-change in whine; an eighth of an octave—1:16 angular difference—would amount to a shift in audio frequency equal to a whole diatonic degree of musical scale.

One-part-in-ten increments of variation in blade-spacing should suffice: amounting to $$\tfrac{1}{10}\times\tfrac{360}{12}\text{degrees}=3\text{ degrees.}$$

A symmetrical pattern emerging from this has blade-rod spacing in clockwise order of 27°, 33°, 33°, 27°, 33°, 27°, totaling 180 degrees, onward 27°, 33°, 33°, 27°, 33°, 27°, around to 360 degrees. Checking opposite blade-spacings, across the axis, it is seen that this has balance.

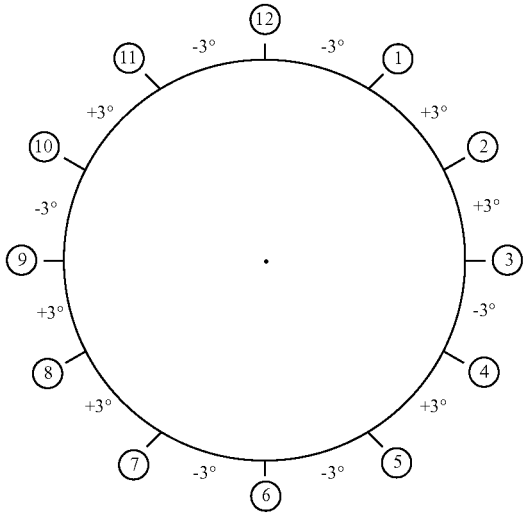

Differential Thermal Expansion

A consulted machinist advised that a one-foot-square steel plate of 1½ inch thickness, heated with a blowtorch to cherry-red at its center, would not fracture at its outer edges. This relieves concern about the comparatively massive Combustion Head's internal thermal stress as a source of failure. The machinist-recommended free-machining steel of choice is type 12L14.

The turbine channels of 0.625-inch depth in both faces of the 1½ inch-thick Combustion Head will leave a satisfactory ¼-inch intervening thickness of steel.

The Coefficient of Linear Expansion of steel, given in *College Physics*, Sixth Edition, Franklin Miller, Jr., Harcourt Brace Jovanovich, is small: $11\times10^{-6}$ per ° C. (The coefficient for aluminum is 2.36 times as much.) So total expansion of the 5.5-inch radius of the Rotor Face, at a turbine operating temperature-rise of 100 Celsius degrees, is (5.5 in.)($11\times10^{-6}$)(100)=$6.05\times10^{-3}$ inch, just over six thousandths of an inch. Close-clearance air-space between the Rotor-faces and the Combustion Head will speed temperature-sharing; differential expansion thus falls happily into the range of machine tolerances.

The Rotors are surrounded by free air within the enclosed air-space of the Turbine Cabinet; the Cabinet bears the full engine torque reaction in supporting the Combustion Head. This mechanical support will be accomplished minimizing heat transfer from the Combustion Head to the cabinet, by trimming down the Combustion Head's four sides, except at its corners where mounting bolts through the Cabinet walls can enter tapped holes in the Combustion Head.

The car's intake and exhaust ducts need to be modified for connection to the Turbine Cabinet; inside it, metal ducts will proceed to respective Combustion Head openings.

Gas Leakage

The clearances between Rotor-Face flat areas and the face of the Combustion Head cannot be minimized below practical tolerance limits. To prevent a dangerous build-up of escaping combustible fuel-air mixture within the Turbine Cabinet, the Scavenging Channel of minimal width and depth, shown in FIG. 1, is cut into the Combustion Head (both its sides) from as near as possible to the sparkplug, around to join the intake channel, where suction is assured.

The metal Intake Duct portion within the Turbine Cabinet is to have a small side-opening so as to draw a small flow of Cabinet-air; replacement air is free to enter the Cabinet via a visible, maintainable screened-and-filtered Ambient Air Inlet of the Cabinet, the cleaning or replacement of which is the sole periodic maintenance duty required for the invention, other than changing the normal vehicular Fuel Filter and vehicle Air (intake) Filter.

Operation

During turbine start-up, the sparkplug, sparking repeatedly during driver-activation of the starter, initiates combustion slightly before top dead center where the momentary counter-rotational-force is not large.

Fuel-air mixture once ignited in the sparkplug-recess can ignite fuel-air packets arriving between successive turbine blades.

Regenerative-Braking Operation

The principle of the invention fits it for use in an automotive regenerative-braking system, as follows.

An accessory un-fueled turbine unit without a sparkplug opening, with instead two adjacent pressure-hose fittings just before and just after the max compression part of the FIG. 1 channel, is mounted on the same shaft as the vehicle's engine-turbine unit. The accessory's filtered air-intake is normally closed by an external air-valve; thus the unit rotates freely, until a light touch on the brake pedal by the driver causes the car's brake-light-switch to open that electrically activated air-valve.

At this, the accessory turbine begins to brake the car by compressing filtered air that leaves via a pressure-hose attached at the maximum-compression point of the turbine channel; the pressure-hose connects via a check-valve to a pressure-tank that stores the car's kinetic energy temporarily.

To come finally to a full stop, the driver applies foot-pressure to the brake pedal.

When the brake pedal is released, a control-valve in the second air-hose opens, and the compressed air feeds from the pressure-tank to the hose-fitting in the power-stroke-zone of the un-fueled accessory turbine unit, helping accelerate the car toward its original speed.

During long moderate downhill braking, air-tank pressure is safely limited by the accessory-turbine's compression-ratio: as the air tank pressure reaches this amount, air in the accessory-turbine simply circulates past both hose-fittings into the turbine's expansion zone; at this, the accessory turbine ceases to assist braking action. The principle serves best in stop-and-go city-driving.

Air-Cycle Heating and Cooling

With the same slight alterations as for regenerative braking, a not-fueled turbine sharing the engine shaft can advantageously serve as a conventional air-cycle heating/cooling compressor-and-expander.

For heating, hotly compressed air from the pre-top-dead-center fitting can feed a suitably sized heat exchanger in the vehicle cabin, then return to the second fitting and enter the power-stroke zone of the turbine. Energy for this is provided by the car's engine, but the efficiency is high, and refrigerant gas isn't required.

For cooling, filtered air enters the accessory turbine's intake, is compressed, and leaves the pre-top-dead-center fitting to travel first through a heat exchanger within the vehicle engine-compartment, then via the second fitting, through the expansion-zone of the turbine, and onward as cool air, via an insulated duct, into the cabin. Efficiency again is high.

Air-Bearings Vice Roller Bearings

I am informed that some aviation jet engines start on roller bearings then run on air bearings.

By enclosing this invention's rotors within a steel sleeve that is surrounded by an external mounting sleeve, compressed-air support of the rotor and of the cylindrical surfaces of other moving parts may be possible.

This would allow the invention to operate at temperatures far exceeding the limits of roller-bearing lubricants. Insulating the Turbine Cabinet would add moderately to thermal efficiency while keeping heat away from its surroundings. A search of the Internet found air-bearing products but no design data on air bearings.

The invention claimed is:

1. A positive-displacement turbine engine comprising:
- two rotors;
- an exhaust opening for discharging exhaust gas;
- an intake opening for receiving air and fuel or air-fuel mixture;
- turbine channels;
- a turbine shaft;
- a plurality of turbine blades; and
- a spark plug;
  - wherein two rotors share a single shaft and face a single central combustion head with opposite sides,
  - wherein the turbine channels are positioned on the opposite sides of the combustion head;
  - wherein each of the turbine channels has a constant depth and a varying width;
    - wherein said each of the turbine channels comprises an intake zone, a compression zone, a combustion-expansion power stroke zone, and an exhaust zone; and
    - wherein said each of the turbine channels widens in the intake zone, narrows in the compression zone, widens in the combustion-expansion power-stroke zone, and narrows in the exhaust zone;
  - wherein the plurality of turbine blades maintain a constant lateral orientation while the two rotors rotate; and
  - wherein each turbine blade of the plurality of turbine blades has a blade-rod with two ends and a downward-offset crank on one end of the blade-rod that maintains the turbine blade in a constant horizontal orientation during rotation of the two rotors.

2. The positive-displacement turbine engine of claim 1, wherein said each blade-rod further comprises a pair of tapered roller bearings that support the blade-rod within one of the two rotors.

3. The positive-displacement turbine engine of claim 1, wherein said each of the two rotors further comprises:
- a front face;
- a rear face;
- a bearing-retainer disc being attached to the rear face of each of the two rotors; and
- holes through which the ends of the blade-rods with the downward-offset cranks protrude;
- a crank-positioning disc-assembly;
  - wherein said crank positioning disc-assembly further comprises:
    - an inner crank-positioning disc,
    - an outer crank-positioning disc, and
    - a hub;
      - wherein each downward-offset crank receives a crank bearing with an outer race, and
      - wherein the outer race of each crank bearing is held between the inner and outer crank-positioning discs; and
- a pair of idler discs situated adjacent to the hub of the crank-positioning disc-assembly causing the crank-positioning disc-assembly to be downward-offset relative to the bearing-retainer disc.

4. The positive-displacement turbine engine of claim 1, wherein an angular separation is between the turbine blades around each of the two rotors,
- wherein the angular separation of the turbine blades around each of the two rotors is varied symmetrically in increments about a rotor axis, thereby suppressing turbine-whine.

* * * * *